US006926328B2

(12) United States Patent
Hellerson

(10) Patent No.: US 6,926,328 B2
(45) Date of Patent: Aug. 9, 2005

(54) COLLAPSIBLE BASKET ASSEMBLY

(75) Inventor: Robert Hellerson, Lakewood, NJ (US)

(73) Assignee: J. A. Cissel Mfg. Co., Lakewood, NJ (US)

( * ) Notice: Subject to any disclaimer, the term of this patent is extended or adjusted under 35 U.S.C. 154(b) by 140 days.

(21) Appl. No.: 10/631,653

(22) Filed: Jul. 31, 2003

(65) Prior Publication Data

US 2005/0023850 A1 Feb. 3, 2005

(51) Int. Cl.[7] ..... A63B 47/02
(52) U.S. Cl. ..... 294/19.2
(58) Field of Search ..... 294/19.2, 169; 215/315.9; 220/4.28, 4.33, 6, 7, 485

(56) References Cited

U.S. PATENT DOCUMENTS 4,811,980 A * 3/1989 Ferrari et al. ..... 294/19.2
6,179,149 B1 * 1/2001 Yeh ..... 220/485
6,302,460 B1 * 10/2001 Carr ..... 294/19.2
6,494,340 B1 * 12/2002 Joo ..... 220/485

* cited by examiner

*Primary Examiner*—Dean J. Kramer
(74) *Attorney, Agent, or Firm*—Clifford G. Frayne

(57) ABSTRACT

A collapsible basket assembly for collecting and transporting tennis balls, the basket assembly having a tray member defining a bottom wall of the basket, the tray member further comprising upstanding partial side walls integral with the bottom wall, each partial upstanding side wall terminating with an upper edge, two extension side walls rotatably mounted to opposing upper edges of partial upstanding side wall portions of the tray, and two extension side walls snap fit to opposing edges of two remaining opposed partial upstanding side walls of the tray member. Snap fit extension side members having a hoop formed at opposing ends of their top edge for engagement with protrusions extending from opposing ends of the upper edges of the rotatable extension side members, the side members being secured by a fastener on the protrusions. A bracket member horizontally secured to the outer surface of each rotatable extension side members for the removable receipt of a U-shaped member serving as a leg support or handle for the collapsible basket.

6 Claims, 6 Drawing Sheets

COLLAPSIBLE BASKET ASSEMBLY

BACKGROUND OF THE INVENTION

1. Field of the Invention

The present invention relates to a basket assembly, and more particularly to a collapsible basket assembly for the collection and transport of tennis balls.

2. Description of the Prior Art

When an individual is practicing tennis or learning the game of tennis, the individual normally practices a variety of shots on a repetitive basis. This prompts the need for a supply of tennis balls easily available to the individual for practice. At the conclusion of practice there is a need to collect the spent tennis balls for reuse by another individual or for reuse at a later time.

A tennis basket assembly was therefore developed which was fabricated of metal or steel rods bent, formed and/or welded to form a cage or basket having a bottom wall integral with four upstanding side walls and a pivotally mounted top wall for operation as a closure means. The space between the steel or metal rods forming the integral bottom wall was slightly less than the diameter of a tennis ball. Still further, there would be rotatably attached to one pair of opposing side walls of the tennis basket, a pair of U-shaped members that when rotated into a downward position served as legs to support the cage or basket member in an elevated position. When these U-shaped arms were rotated into a substantially vertical upward position, they formed handles for transport of the tennis basket by the individual.

In use, a full basket would be supported in an erect upstanding position by the U-shaped legs. The pivotal top wall would be open allowing the individual access to the tennis balls stored inside. At the conclusion of practice when the basket or cage had been depleted of tennis balls, the individual would rotate the U-shaped members upwardly to form a handle for the basket and pivotally position the top wall in a closed position. The individual could then proceed to where the tennis balls had collected on the ground and using the handle, push the basket or cage member down over the tennis ball slightly compressing the tennis ball with the metal and steel rods of the bottom wall and forcing the tennis ball into the cage. This process would be repeated until all of the tennis balls had been collected within the cage or basket. The individual would then commence to further practice or the collected tennis balls and basket would be provided to another individual for his or her practice.

The basket, integrally formed with the bottom wall and four upstanding side walls proved to be extremely sturdy and particularly adapted for its purpose. Its one drawback had nothing to do with its intended purpose, rather the drawback had to do with the manner and sturdiness of its construction. The basket itself might proximate a one foot cube with the U-shaped leg members having approximate length of two feet. As such the cost of transportation of the baskets from the manufacturer to the retailer was costly because of the space requirement per basket. A further expense was realized by the retailer in that the basket took up significant storage space in inventory. It was therefore a need to fabricate a tennis basket which could be shipped in a volumetrically smaller container and still not require extensive assembly when purchased and would retain the sturdiness and the strength over time equivalent to the prior art units. U.S. Pat. No. 6,179,149 to Yeh attempted to address this problem with a collapsible basket.

The collapsible basket of Yeh is formed of a bottom wall having two opposing side walls rotatably secured to the edges of the bottom wall with the other opposing side walls snap fitting into a bracket along two opposite edges of the bottom wall. The two snap fit side walls have an eyelet at the opposing ends of its upper edge which slidably fit over two protrusions extending from opposite directions at opposite ends of the side walls which are rotatably secured to the bottom wall. Fasteners are secured on each of these protrusions. Still further, one of the side walls has a top wall rotatably secured thereto. The collapsible basket of Yeh has two U-shaped members serving as legs and arms rotatable from a vertical upward position to a vertical downward position by means of brackets mounted on opposing side walls and maintained in position by a plurality of pairs of beads positioned on opposing lower edges of the basket and opposing upper edges of the basket. The collapsible basket of Yeh is utilized in the same manner as the baskets of the prior art. The shortcoming of the Yeh basket is that the rotatable side walls and the bracket fit side walls are connected to the bottom wall along the edges of the bottom wall. It is this area of the basket which takes the most stress when collecting the spent tennis balls because the basket is literally jammed over the tennis balls repeatedly in picking them up. As such it comes into abrupt and significant contact with the court surface repeatedly such that the sturdiness and longevity of the prior art baskets is not achieved by the collapsible basket of Yeh at the expense of lowering shipping and inventory costs.

Applicant's invention addresses both issues with a collapsible basket which provides the sturdiness and longevity of the prior art with the ability to collapse and thus minimize shipping and storage volume space.

OBJECTS OF THE INVENTION

An object of the present invention is to provide for a collapsible basket for the collection and transport of tennis balls.

A further object of the present invention is to provide for a novel collapsible basket for the collection and transport of tennis balls which basket exhibits a sturdiness and longevity.

A still further object of the present invention is to provide for a novel collapsible basket for the collection and transport of tennis balls which collapsible basket reduces the volumetric space required in shipping and storing the collapsible basket.

SUMMARY OF THE INVENTION

A collapsible basket assembly for collecting and transporting tennis balls the basket assembly having a tray member defining a bottom wall of the basket the tray member further comprising upstanding partial side walls integral with the bottom wall each partial upstanding side wall terminating with an upper edge, two extension side walls rotatably mounted to opposing upper edges of partial upstanding side wall portions of the tray, and two extension side walls snap fit to opposing edges of two remaining opposed partial upstanding side walls of the tray member, snap fit extension side members having a hoop formed at opposing ends of their top edge for engagement with protrusions extending from opposing ends of the upper edges of the rotatable extension side members, the side members being secured by a fastening means on the protrusions, a bracket member horizontally secured to the outer surface of each rotatable extension side members for the removable receipt of a U-shaped member serving as a leg support or handle for the collapsible basket, the leg supports being held in either a vertical upward position or vertical downward position by a pair of fixed spheres secured to the top edge of opposing partial side walls of the tray to which the rotatable extension sides are secured.

BRIEF DESCRIPTION OF THE DRAWINGS

These and other objects of the present invention will become apparent particularly when taken in light of the following illustrations where.

DETAILED DESCRIPTION OF THE INVENTION

Figure 1:
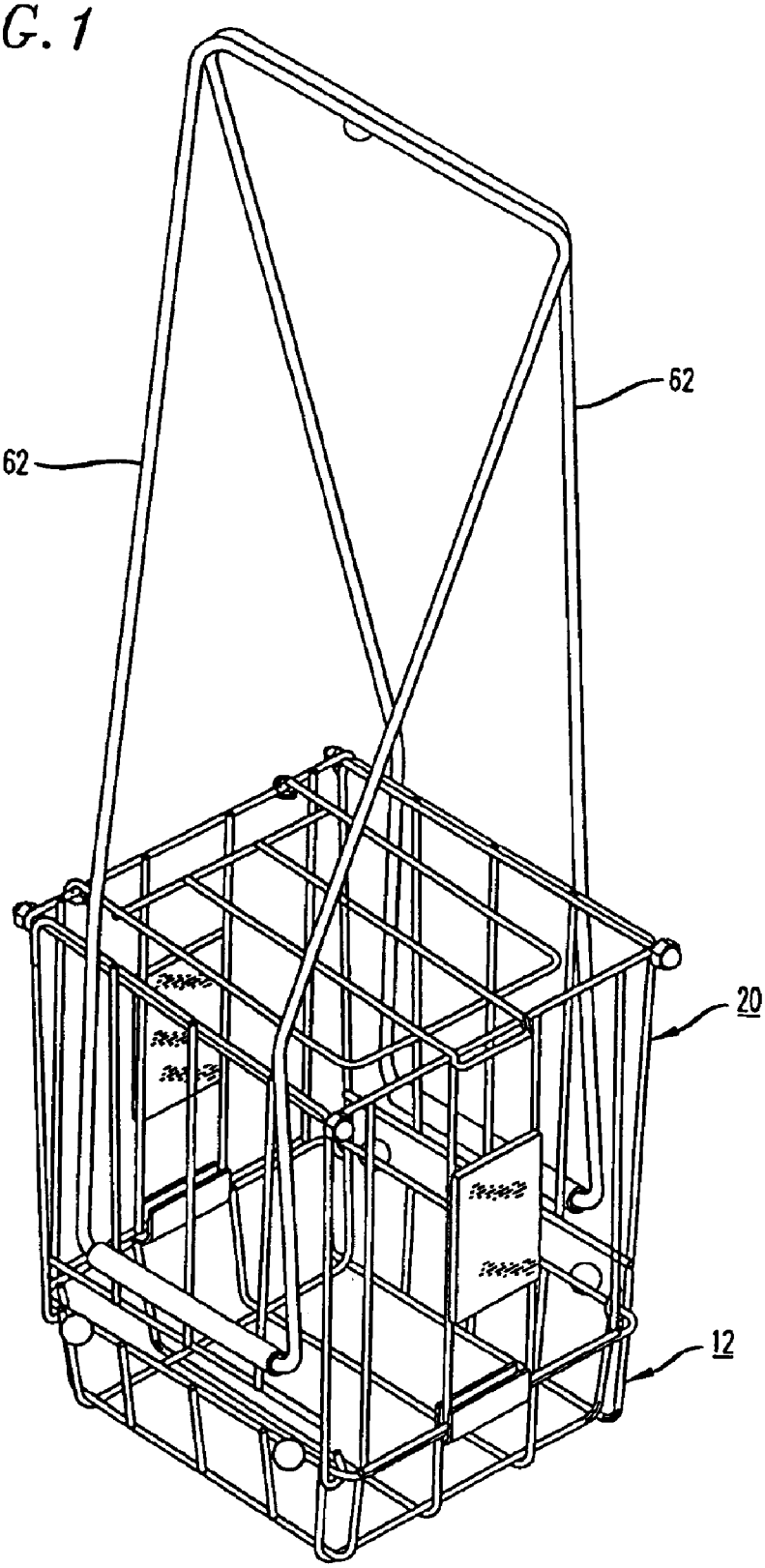
FIG. 1 is a perspective view of the collapsible basket of the present invention.
Figure 2:
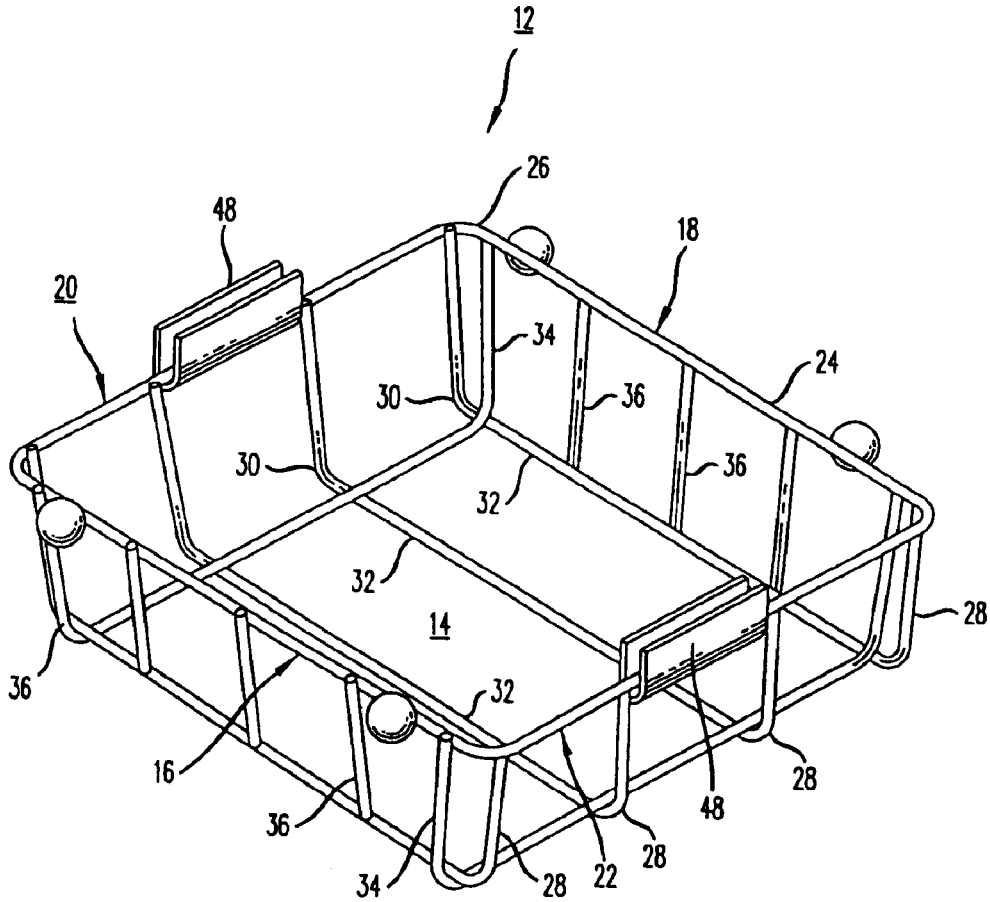
FIG. 2 is a perspective assembled view of the tray member or base of the present invention.
Figure 3:
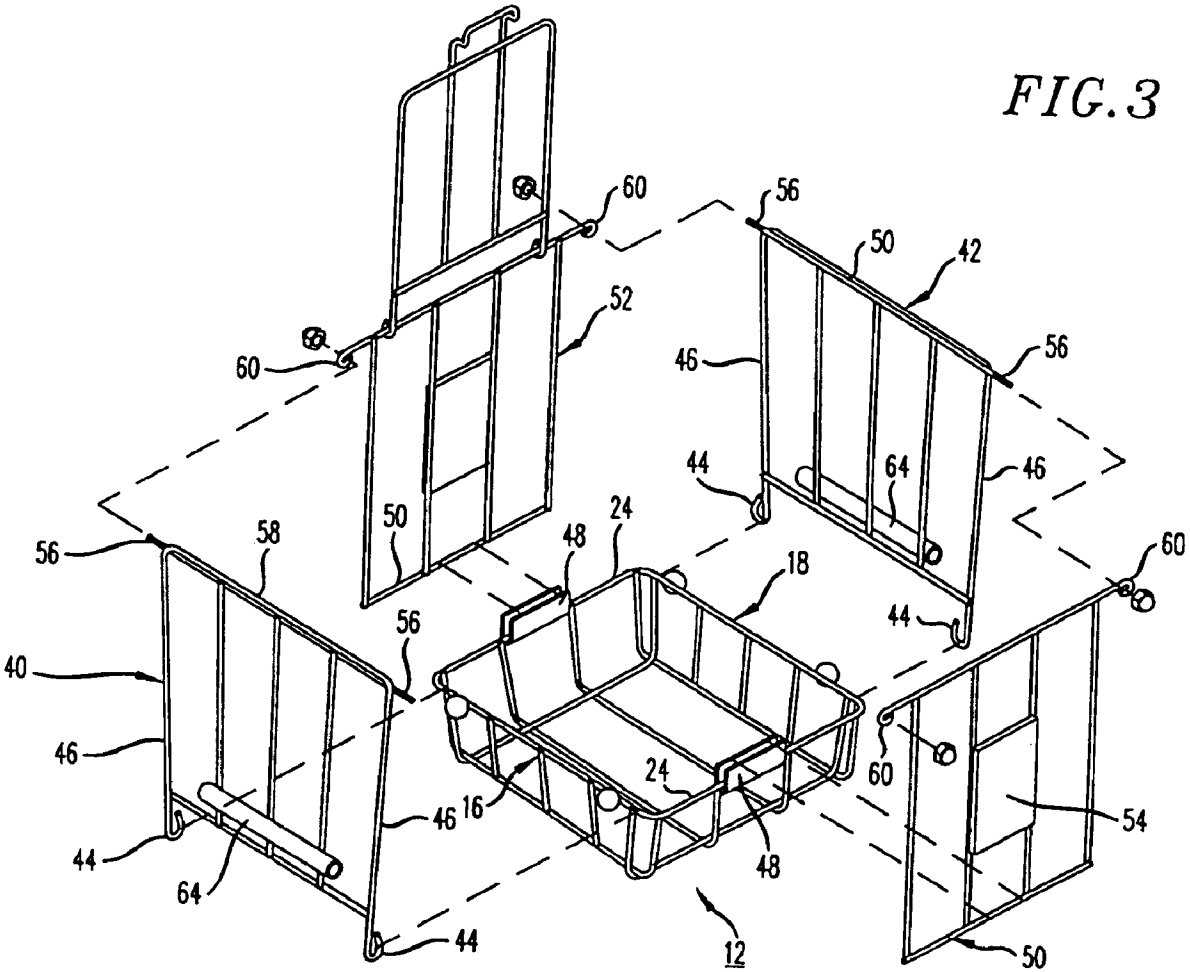
FIG. 3 is an exploded view of the collapsible basket of the present invention.
Figure 4:
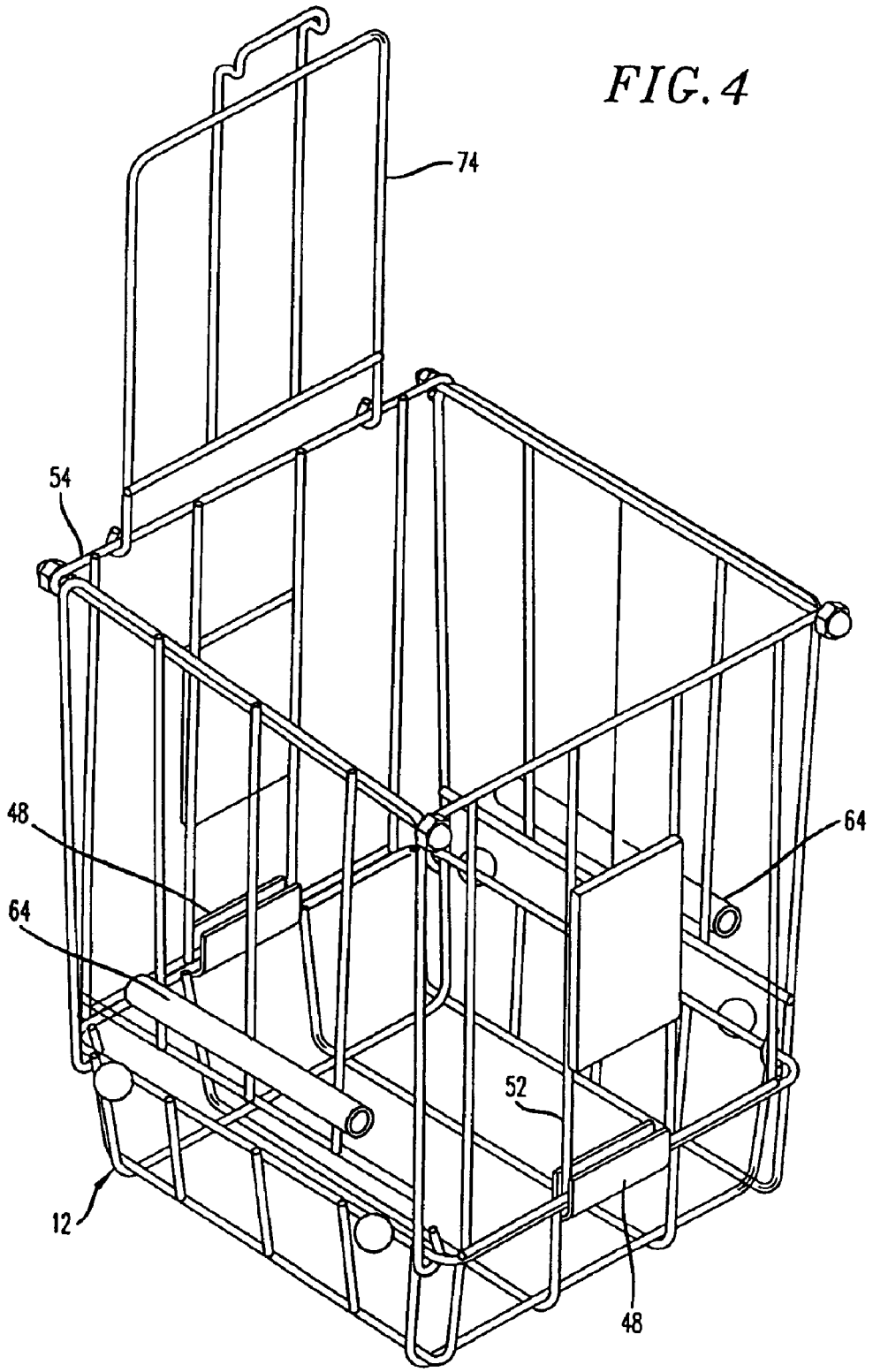
FIG. 4 is a perspective view of the collapsible basket of the present invention without handles attached.
Figure 5:
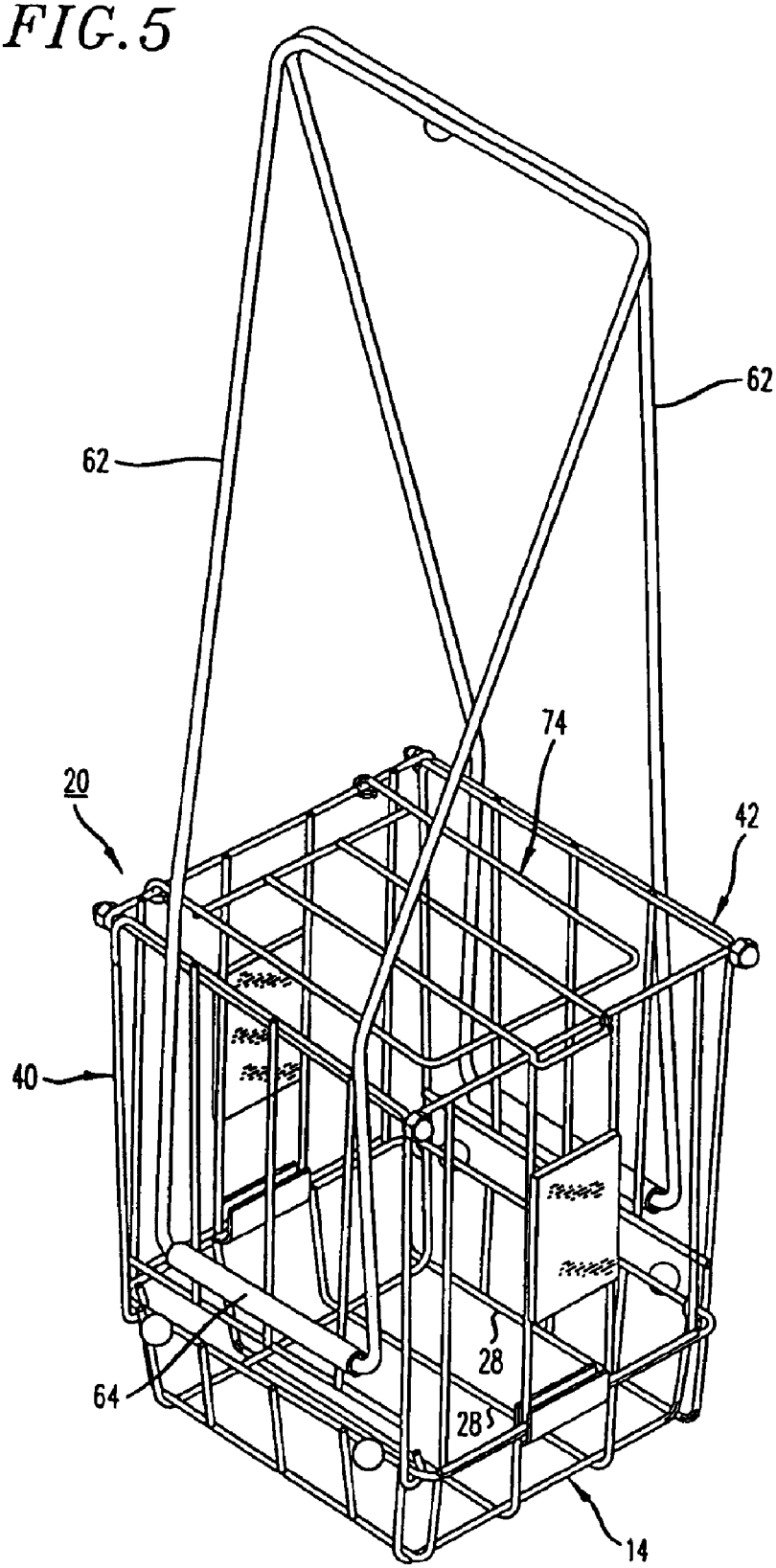
FIG. 5 is a perspective view of the basket of the present invention with leg members positioned as handles.
Figure 6:
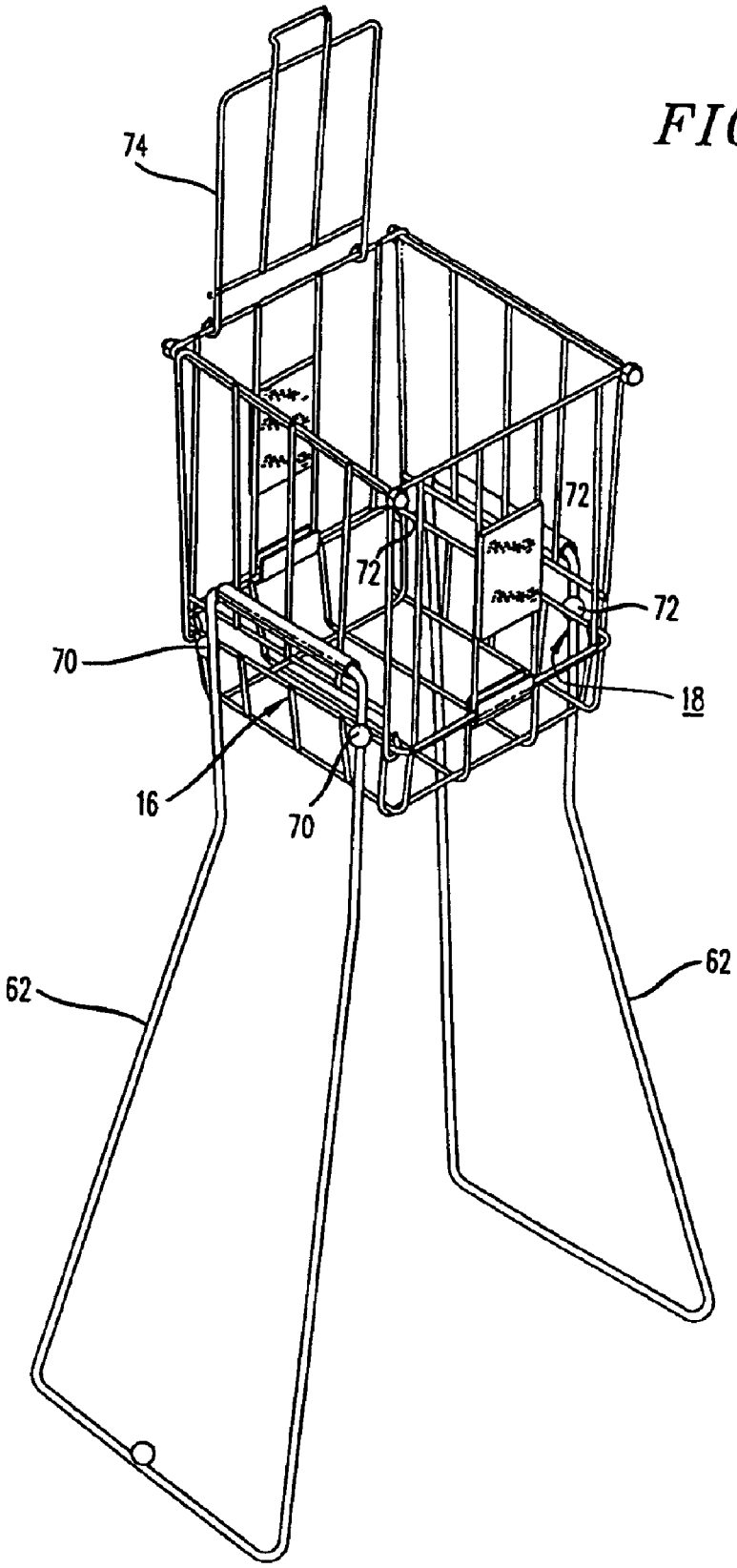
FIG. 6 is a perspective view of the basket of the present invention with the leg members positioned as leg supports for the basket.

FIG. 1 is a perspective view of the collapsible basket assembly of the present invention which comprises a basket member 20 and a pair of U-shaped members 62 which serve as handles and/or support legs. The basket 20 is formed of a tray member 12 which has an integral bottom wall 14 formed integrally with a front wall 16, rear wall 18, and side walls 20 and 22. Each of the walls and bottom is formed of a plurality of metal rods welded to one another or otherwise suitable secured so as to form tray member 12 with an upper peripheral edge 24.

Each of the walls 16, 18, 20, and 22 and bottom wall 14 is in the form of a grate. In a preferred embodiment, tray member 12 is formed of an upper continuous rod 26 formed in the shape of a square defining the upper peripheral edge of tray 12. Side walls 20 and 22 and bottom wall 14 are formed by four spaced apart identical rods 28, each having a 90 degree bend 30 at opposing ends such that when the ends are secured to opposing upper peripheral edge 24, the 90 degree bends 30 form the opposing side walls and the middle portions 32 of rods 28 form the bottom wall 14. Distance between identical rods 28 is slightly less than the diameter of a regulation tennis ball as described hereafter.

The bottom wall 14 is further formed by two rods 34 similar in shape to rods 28, rods 34 extending between front and rear upper peripheral edge 24, and are secured to the upper peripheral edge 24 proximate the corners thereof. The remainder of front and rear walls 16 and 18 are formed by a plurality of rod segments 36 extending between front and rear peripheral edge 24 and the two outer most rods 28 forming bottom wall 14.

Tray member 12 forms the base of collapsible basket 20. There is secured to front wall 16 and rear wall 18 a further extension 40 and 42 of front wall and rear wall 16 and 18 respectively. These extensions 40 and 42 are pivotally secured to the front and rear wall 16 and 18 of tray member 12 by loops 44 formed at the lower end of the rods 46 utilized to form the grating pattern of extensions 40 and 42.

The upper peripheral edge 24 of the side walls 20 and 22 of tray member 14 have formed thereon a slotted bracket member 48 for the slidable receipt of the lower edge 50 of an extension side wall 52 and 54 which are also formed in the manner of a grate from metal rods intersecting and being secured by welding or other suitable means.

Opposing ends 56 of upper edge 58 of front and rear wall extensions 40 and 42 are threaded and extend beyond rods 46 forming extensions 40 and 42. Each of the top edges of side wall extensions 52 and 54 is formed with a loop 60. In assembly, side wall extensions 50 and 52 are inserted into bracket 48 and extensions 40 and 42 of front and rear wall extensions are pivoted upwardly about peripheral edge 24 and loops 60 are engaged on the opposing ends 56 of upper edge 58 of extensions 40 and 42 and secured by a fastener.

Basket 20 is now ready for final assembly of U-shaped members 62 which serve as combination legs and transport handle. Extensions 40 and 42 have positioned thereon a bracket means 64 in a horizontal orientation. U-shaped members 62 are open at one end having inwardly depending fingers for engagement with bracket 64 and U-shaped members 62 are closed at their opposing end. Each U-shaped member 62 is angled between their respective open and closed ends so that that portion of U-shaped members 62 proximate to the open end is juxtaposed against extension walls 40 and 42 when U-shaped members are in a handle (up) orientation and the balance of U-shaped members 62 are angled toward each other such that the closed ends are juxtaposed to form a handle for transport and collection.

In that regard, collection is accomplished by positioning the bottom wall 14 of tray member 12 over one or more tennis balls positioned on the court and pressing downwardly with U-shaped members 62 in the handle orientation. The tennis ball is slightly compressed between rods 28 and enters basket 20. The procedure is repeated until all the tennis balls have been collected or the basket 20 is full.

In the support orientation (down) U-shaped members 62 are rotated within bracket 64 such that U-shaped members 62 are juxtaposed the front and rear walls 16 and 18 of tray 12 and the angled orientation of U-shaped members 62 is reversed such that the closed ends flare outwardly to provide a wider base and thus a greater stability for the basket when utilized in a support position. To aid and maintain the U-shaped member 62 in a stable support orientation, a pair of spheres 70 and 72 are secured to the upper peripheral edge 24 of front and rear wall 16 of tray 14, proximate the corners such that the legs of U-shaped members 62 can be pinched or compressed therebetween and mechanically and frictionally secured. Subsequent compression will release the legs of U-shaped members 62 for reorientation as a handle means. When oriented as a support means, U-shaped legs 62 support the basket 20 at a comfortable height above the surface of the tennis court which allows the player to remove a ball from the basket for practice or serve without having to bend completely over to obtain the tennis ball from the surface of the court.

Additionally, basket 20 may be fitted with a rotatable grated lid 74 which is rotatably secured to the top edge of extension side wall 52 or 54 by means of loops formed in two of the rods forming the grate, lid 74 having a frictionally engageable latch at its opposing end for engagement with the opposing extension side wall 52 or 54.

Still further, the closed ends of U-shaped members 62 may have a securing means formed thereon in order to maintain the closed ends in juxtaposition when they are oriented in the handle mode. In the embodiment shown, a single sphere is shown secured to one of the closed ends of U-shaped members 62 which allows for the forming of an overlapping snap fit of the closed ends when utilized in the handle orientation.

In the embodiment illustrated, the collapsible basket 20 is a basket for transport and collection by hand. However, due to its construction and fabrication, it can also be adapted to receive a pair of wheels which we secured proximate the corner formed by the intersection of the side walls 20 and 22 and rear or front walls 16 or 18 of tray member 12 such that the collapsible basket 20 could be rolled from location to location in either a push or pull mode.

The present invention has been described with respect to the exemplary embodiments thereof, it will be recognized by those of skill in the art that many modifications or changes can be achieved without departing from the spirit and scope of the invention. Therefore it is manifestly intended that the invention be limited only by the scope of the claims and the equivalence thereof.

I claim:

1. A collapsible basket assembly for the collection and transport of tennis balls, said collapsible basket assembly comprising:

a basket formed of a lower tray assembly member, said lower tray assembly member having an integrally formed bottom wall, and a partial front wall, partial rear wall, and two opposing partial side walls formed by a plurality of cross linked metal rods in a grid like formation, said lower tray assembly member defined by an upper peripheral edge formed by the upper edge of said partial front wall, said partial rear wall, and said two opposing partial side walls;

an extended front wall and an extended rear wall each having a top edge and a bottom edge, said bottom edges connected pivotally and rotatably to said peripheral edge of said lower tray assembly member formed by said partial front wall and said partial rear wall of said lower tray assembly member, said top edge of said extended front wall and said extended rear wall having protrusions extending in opposite directions from opposing ends thereof;

two opposing extended side walls each having a top edge and a bottom edge, said bottom edges releasably, slideably secured in an upstanding bracket member positioned on said peripheral edge of said partial side walls of said lower tray assembly member, said top edges of said extended side walls being formed with loops on opposing ends thereof for the slideable insertion of said protrusions extending from said top edge of said extended front wall and said extended rear wall therethrough;

removable securing means connected removably to said protrusions to prevent dis-engagement between said protrusions and said loops;

a pair of opposing U-shaped members having a closed end and two arm portions with distal ends connected pivotally to said extended front wall and extended rear wall of said basket, said U-shaped members rotatable in an upward orientation so as to serve as a handle and transport means for said basket for the collection of tennis balls and rotatably oriented downwardly to serve as legs for the support of said basket permitting said basket to be oriented in a stand up position for the disbursement of said tennis balls collected in said basket;

a pair of sphere members positioned on the peripheral edge of said partial front wall and said partial rear wall of said lower tray assembly member, said spheres cooperable with each of said U-shaped members so as to mechanically and frictionally engage said arm portions of said U-shaped members between said spheres when said U-shaped members are oriented in a downward position to support said basket.

2. The collapsible basket assembly in accordance with claim 1 wherein said basket assembly is assembled from a plurality of secured, interconnected metal rods forming a grate-like structure.

3. The collapsible basket assembly in accordance with claim 2 wherein said metal rods forming said bottom wall and said partial end walls of said lower tray assembly member are spaced apart a distance slightly less than the diameter of said tennis ball.

4. The collapsible basket assembly in accordance with claim 1 wherein a grate-like lid member is rotatably secured to the upper edge of one of said extended side walls or said extended front wall or extended rear wall, said lid member having a securing means engageable with said opposing extended side wall or opposed extended front or rear wall.

5. The collapsible basket assembly in accordance with claim 1 wherein said arm members of said U-shaped members are formed with an angled portion proximate said closed end of said arm portions juxtaposing said closed ends when said arm portions are oriented in an upward handle orientation.

6. The collapsible basket assembly in accordance with claim 1 wherein one of said closed ends of said U-shaped members is formed with a sphere thereon for frictional engagement with said closed end of said opposing U-shaped member and frictionally engaged said U-shaped members when oriented in an upward handle orientation.

* * * * *